US007902945B2

(12) United States Patent
Ishii et al.

(10) Patent No.: US 7,902,945 B2
(45) Date of Patent: Mar. 8, 2011

(54) DUAL MODE RING RESONATOR FILTER WITH A DUAL MODE GENERATING LINE DISPOSED INSIDE THE RING RESONATOR

(75) Inventors: Masatoshi Ishii, Kawasaki (JP); Kazunori Yamanaka, Kawasaki (JP); John D. Baniecki, Kawasaki (JP); Akihiko Akasegawa, Kawasaki (JP); Teru Nakanishi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 13 days.

(21) Appl. No.: 12/117,322

(22) Filed: May 8, 2008

(65) Prior Publication Data

US 2008/0297284 A1 Dec. 4, 2008

(30) Foreign Application Priority Data

May 21, 2007 (JP) ..... 2007-134501
Mar. 11, 2008 (JP) ..... 2008-060429

(51) Int. Cl.
*H01P 1/203* (2006.01)
*H01B 12/02* (2006.01)

(52) U.S. Cl. ..... 333/204; 333/219; 333/99 S; 333/205; 505/210

(58) Field of Classification Search ..... 333/204, 333/219, 99 S, 205; 505/210
See application file for complete search history.

(56) References Cited

U.S. PATENT DOCUMENTS 5,172,084 A * 12/1992 Fiedziuszko et al. ..... 333/204
5,400,002 A * 3/1995 Takahashi et al. ..... 333/204
6,360,112 B1 * 3/2002 Mizuno et al. ..... 505/210

FOREIGN PATENT DOCUMENTS

JP 09-139612 5/1997
JP 2000-209002 A 7/2000
JP 3304724 B2 7/2002
JP 2006-115416 4/2006

* cited by examiner

*Primary Examiner* — Benny Lee
(74) *Attorney, Agent, or Firm* — Fujitsu Patent Center

(57) ABSTRACT

A dual-mode filter capable of providing a high degree of design freedom and/or tunability is disclosed. The dual-mode filter includes a ring resonator; an input feeder and an output feeder disposed substantially orthogonal with respect to each other and with respect to the ring resonator so as to be electromagnetically coupled to the ring resonator; and a dual-mode generating line disposed inside the ring resonator in a manner so that the dual-mode generating line does not overlap with a line extending from the input feeder or a line extending from the output feeder.

4 Claims, 17 Drawing Sheets

$$k = \frac{f_2^2 - f_1^2}{f_2^2 + f_1^2}$$

DUAL MODE RING RESONATOR FILTER WITH A DUAL MODE GENERATING LINE DISPOSED INSIDE THE RING RESONATOR

CROSS-REFERENCE TO RELATED APPLICATION

The present application is based on Japanese Priority Application Nos. 2007-134501 filed on May 21, 2007 and 2008-060429 filed on Mar. 11, 2008, the entire contents of which are hereby incorporated herein by reference.

BACKGROUND OF THE INVENTION

1. Technical Field

The present invention generally relates to high-frequency filters used in, for example, the wireless communication field, and more particularly to a dual-mode filter generating two different resonant modes by introducing electromagnetic discontinuity in a ring resonator, and a tuning method of such a dual-mode filter.

2. Background Art

Recently, with prevalence and development of cell phones, fast and high-capacity transmission technologies have becomes indispensable. To realize such a fast and high-capacity transmission technology, a wide frequency band is required. Therefore, the frequency range used in wireless communications is being shifted to a higher frequency range. As a result, the filters used for wireless communications are need to have characteristics capable of selectively passing a desired communication frequency and cutting off the frequency components other than the desired pass band even in a high frequency range. Furthermore, there is strong demand for the sizes and weights of such wireless communication apparatuses using high frequency circuit elements to be further reduced.

A ring resonator is known as a resonant filter including a ring having a circumference of one wavelength or an integral number of wavelengths as an electrical path length. To improve the space efficiency of the ring resonator, methods of generating two resonant modes (a dual-mode resonator) within a single resonator and obtaining sharp filter characteristics are disclosed in Patent Documents 1 and 2.

Patent Document 1: Japanese Patent No. 3304724

Patent Document 2: Japanese Patent Application Publication No. 2000-209002

Patent Document 1 discloses a dual-mode filter including a ring resonator, where an input line and an output line are coupled to the ring resonator orthogonal to each other. A stub is provided in between a coupling point of the input line and the output line with respect to the ring resonator. Due to the stub, an electromagnetic discontinuity point (or perturbation) is generated, thereby generating a dual-mode resonator. However, disadvantageously, current concentration occurs in the vicinity of the discontinuity point in the ring of the resonator, which may degrade the power durability of the resonator.

Further, Patent Document 2 discloses a dual-mode filter including a ring resonator, where an input line and an output line are coupled to the ring resonator orthogonal to each other. A distributed coupling line is provided at the position on a median line equidistant from the coupling points of the input and the output lines and the resonator along the outer circumference of the ring of the resonator. Due to the distributed coupling line, a dual-mode ring resonator is generated. However, disadvantageously, the position at which the distributed coupling line can be disposed is limited to the point on the median line equidistant from the coupling points, thereby reducing the design degree of freedom for the position of the distributed coupling line.

SUMMARY OF THE INVENTION

The present invention is directed to various embodiments of a dual-mode filter that includes a dual-mode generating line disposed inside a ring resonator in a manner so that the dual-mode generating line does not overlap either one of a line extending from an input feeder and a line extending from an output feeder

BRIEF DESCRIPTION OF THE DRAWINGS

Other objects, features, and advantages of the present invention will become more apparent from the following descriptions when read in conjunction with the accompanying drawings, in which.

DETAILED DESCRIPTION OF THE INVENTION

Figure 1A:
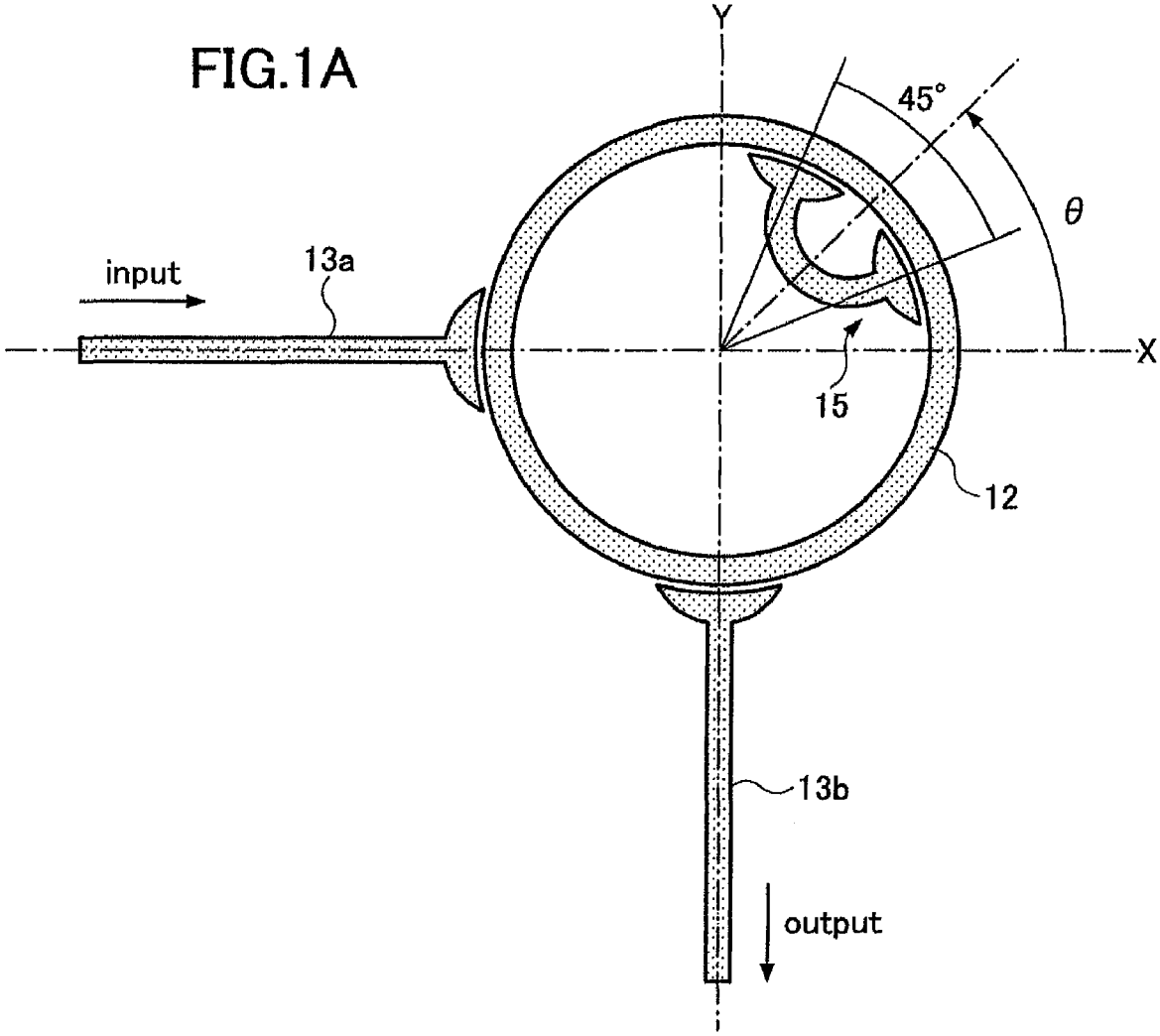
FIG. 1A is a view schematically showing a configuration of a dual-mode resonant filter according to a first embodiment of the present invention.

In the following, embodiments of the present invention are described with reference to the accompanying drawings. FIG. 1A schematically shows a configuration of a ring resonator for a dual-mode resonant filter according to a first embodiment of the present invention. As shown in FIG. 1A and FIGS. 2A through 2C, the resonant filter includes a ring resonator 12, an input feeder 13*a*, an output feeder 13*b*, and a dual-mode generating line 15. Both the input feeder 13*a* and the output feeder 13*b* are electromagnetically coupled to the ring resonator 12 in a manner so that a line "X" extending from the input feeder 13*a* and a line "Y" extending from the output feeder 13*b* cross each other at a substantially right angle. The dual-mode generating line 15 is disposed inside the ring resonator 12 in a manner so that the dual-mode generating line 15 does not overlap the extended lines "X" and "Y" as shown in FIG. 1A.

Figure 1B:
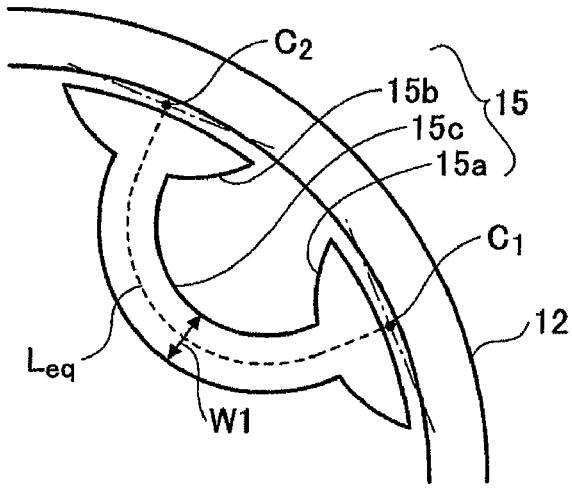
FIG. 1B is a partially enlarged view of the dual-mode generating line and the ring resonator in FIG. 1A.

FIG. 1B is a partially enlarged view of the dual-mode generating line 15 and the ring resonator 12 in FIG. 1A. As shown in FIG. 1B, the dual-mode generating line 15 includes a first port 15*a*, a second port 15*b*, and a waveguide 15*c*. Each of the first port 15*a* and the second port 15*b* is electromagnetically coupled to the ring resonator 12. The waveguide 15*c* has an arc shape, connects the first port 15*a* and the second port 15*b*, and has an electrical length of "Leq". The electrical length "Leq" of the dual-mode generating line 15 can be set arbitrarily, provided that an open angle between the ring resonator 12 radii passing through the first port 15*a* and the second port 15*b* with respect to the center of the ring resonator 12 is less than 90 degrees as shown in FIG. 1A. The electrical length "Leq" can also be changed by changing the curvature of the waveguide 15*c* while the open angle is fixed. Herein, the electrical length "Leq" refers to a line length between an electromagnetic coupling point "C1" between the first port 15*a* and the ring resonator 12 and an electromagnetic coupling point "C2" between the second port 15*b* and the ring resonator 12.

More specifically, the electrical length "Leq" of the dual-mode generating line 15 is set in a range of less than one-fourth of the circumference of the ring resonator 12. For example, the electrical length "Leq" is equal to or more than an arc length of the ring resonator 12 corresponding to the open angle and to less than one-fourth of the circumference of the ring resonator 12. Preferably, the open angle is equal to or more than 36 degrees and less than 90 degrees. This is because when the open angle is less than 36 degrees, it becomes difficult to obtain sufficient electromagnetic coupling between the dual-mode generating line 15 and the ring resonator 12.

Further, the coupling between the dual-mode generating line 15 and the ring resonator 12 can be adjusted by changing at least one of the electrical length "Leq" of the dual-mode generating line 15 and a width "W1" of the dual-mode generating line 15 (namely, the width of the waveguide 15*c*) when the ring resonator 12 is designed so that the circumference of the ring resonator 12 equals one wavelength of a desired frequency even in a case where the positions of the electromagnetic coupling point "C1" (between the first port 15*a* and the ring resonator 12) and the electromagnetic coupling point "C2" (between the second port 15*b* and the ring resonator 12) are fixed in a manner so that the open angle is, for example, 45 degrees as shown in FIG. 1A. The pass frequency bandwidth (pass band) of a band pass filter can be broadened by increasing the electrical length "Leq" of the dual-mode generating line 15. Further, the pass band of a band pass filter can also be changed by reducing the width "W1" of the dual-mode generating line 15 (namely, the width of the waveguide 15*c*). Still further, as is described below, the pass band of a band pass filter can be adjusted by changing the coupling capacitance between the dual-mode generating line 15 and the ring resonator 12.

As described above, the dual-mode generating line 15 can be disposed in any position, provided that the dual-mode generating line 15 does not overlap either one of the lines "X" and "Y" extending from the input feeder 13*a* and the output feeder 13*b*, respectively. However as shown in FIG. 1A, preferably, the dual-mode generating line 15 is disposed in a manner so that an angle "θ" defined as an angle formed between a line passing through the center of the dual-mode generating line 15 and the center of the ring resonator 12 and the extended line "X" has a value given as:

$$45\text{ degrees}\pm n\pi/2 (n=0, 1, 2, \ldots)$$

Figure 2A:
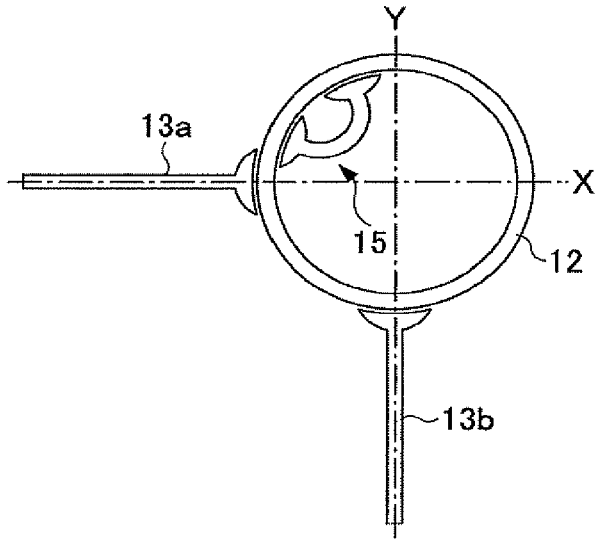
FIGS. 2A through 2C are plan views each showing a dual-mode filter according to a modified first embodiment of the present invention.
Figure 2B:
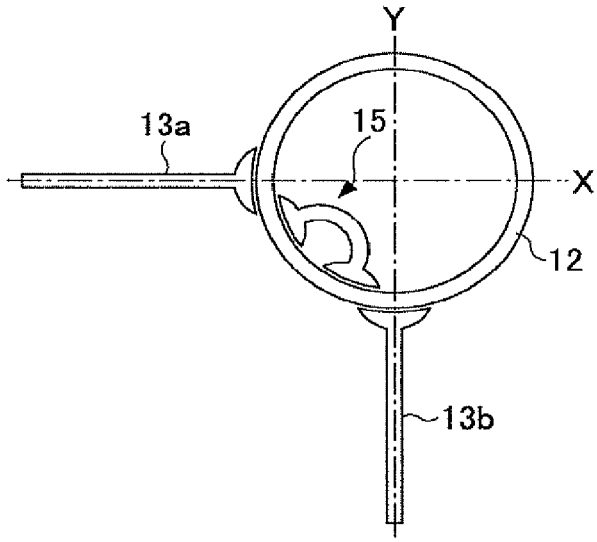
Figure 2C:
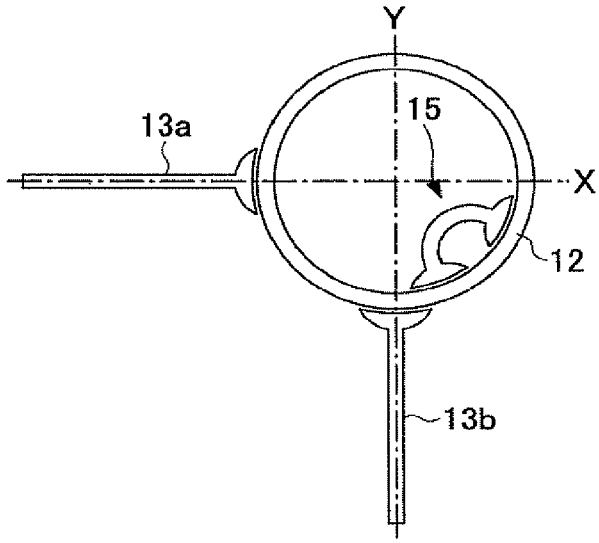

Accordingly, as shown in FIGS. 2A through 2C, the angles "θ" are 135 degrees (45 degrees+π/2), 225 degrees (45 degrees±π/2), and 315 degrees (45 degrees±3π/2 or 45 degrees−π/2), respectively. As described above, however, the angle "θ" may be other than 45 degrees±nπ/2 (n=0, 1, 2, . . . ), provided that the dual-mode generating line 15 does not overlap either one of the substantially mutually orthogonal extended lines "X" and "Y".

Referring back to FIG. 1A, a signal (carrier wave) transferred through the input feeder 13*a* is electromagnetically coupled to the ring resonator 12 and travels along the ring resonator 12 evenly in both the clockwise and the counter-clockwise directions. The electric field intensity of the carrier wave becomes maximal at the coupling point between the input feeder 13*a* and the ring resonator 12. For example, in a case where the carrier wave travels in the clockwise direction, the electric field of the electromagnetic wave having traveled only through the ring resonator 12 becomes minimal at the position of the output feeder 13*b* whose phase is shifted 3n/2 with respect to the input feeder 13*a*. The electromagnetic wave just passes the position of the output feeder 13*b* without being coupled to the output feeder 13*b*. However as shown in FIG. 1B, since the first port 15*a* of the dual-mode generating line 15 is electromagnetically coupled to the ring resonator 12, some of the electromagnetic wave travels into the waveguide 15*c* of the dual-mode generating line 15 though the first port 15*a*. The electromagnetic wave is further coupled to the ring resonator 12 at the second port 15*b* and travels toward the output feeder 13*b*. In this sense, the dual-mode generating line 15 serves as a path of the electromagnetic wave.

Here, it is assumed that the electrical length of the dual-mode generating line 15 is "λ/8" (λ: wavelength of the electromagnetic wave entering the ring resonator 12) and the electrical length of the arc-shaped portion of the ring resonator 12 facing the dual-mode generating line 15 is also "λ/8". In this case, the phase of the reflected wave (traveling into the dual-mode generating line 15) at the coupling point of the output feeder 13*b* is shifted 2π with respect to the coupling point of the input feeder 13*a*. Therefore, the electric field intensity at the coupling point of the output feeder 13*b* becomes maximal. Accordingly, the electromagnetic wave component reflected by the dual-mode generating line 15 is coupled into the output feeder 13*b* and is output from the ring resonator 12.

The same phenomenon occurs in the electromagnetic wave traveling into the ring resonator 12 in the counterclockwise direction. Namely, the electromagnetic wave having traveled into the dual-mode generating line 15 is coupled to the output feeder 13*b* and is output from the ring resonator 12 through the output feeder 13*b*. These phenomena suggest that two mutually orthogonal resonant modes are generated in the ring resonator 12. As described below, a coupling coefficient of the two resonant modes can be adjusted by changing at least one of the electrical length "Leq" of the dual-mode generating line 15, the width "W1" of the dual-mode generating line 15 (namely the width of the waveguide 15*c*), and the coupling capacitance between the dual-mode generating line 15 and the ring resonator 12.

Advantageously, in a dual-mode filter according to an embodiment of the present invention, the dual-mode generating line 15 is disposed inside the ring resonator 12, thereby improving space efficiency and reducing the size of the dual-mode filter. Further advantageously, the ring resonator 12 and the dual-mode generating line 15 are formed in circular arc shapes, thereby evenly dispersing the concentration of current that may occur somewhat along the edge of the ring resonator 12 and the dual-mode generating line 15. As a result, the power durability of the dual-mode filter is improved.

Figure 3A:
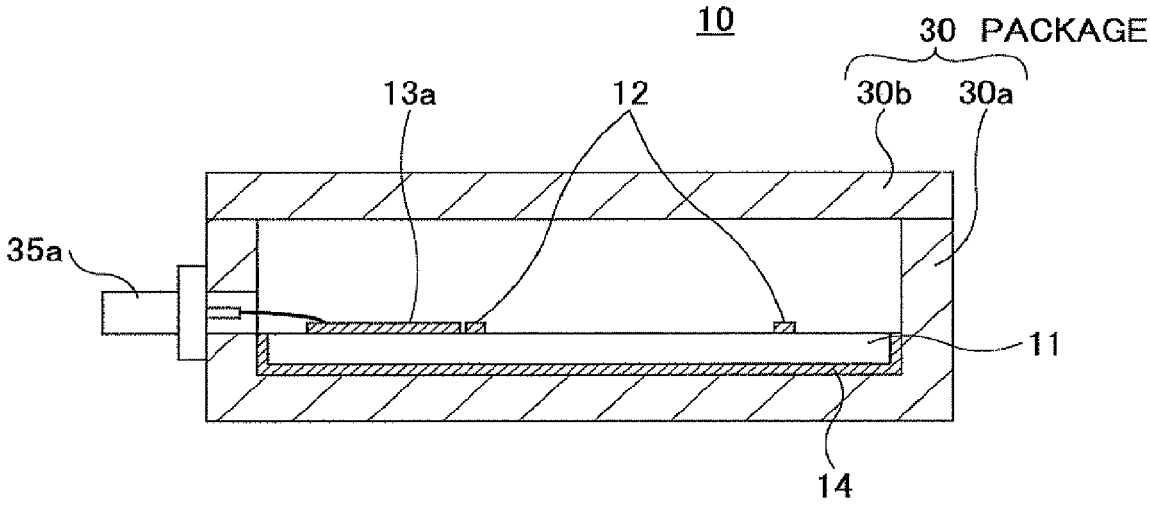
FIGS. 3A and 3B are cut-open views each showing a packaged dual-mode filter according to the first embodiment of the present invention.
Figure 3B:
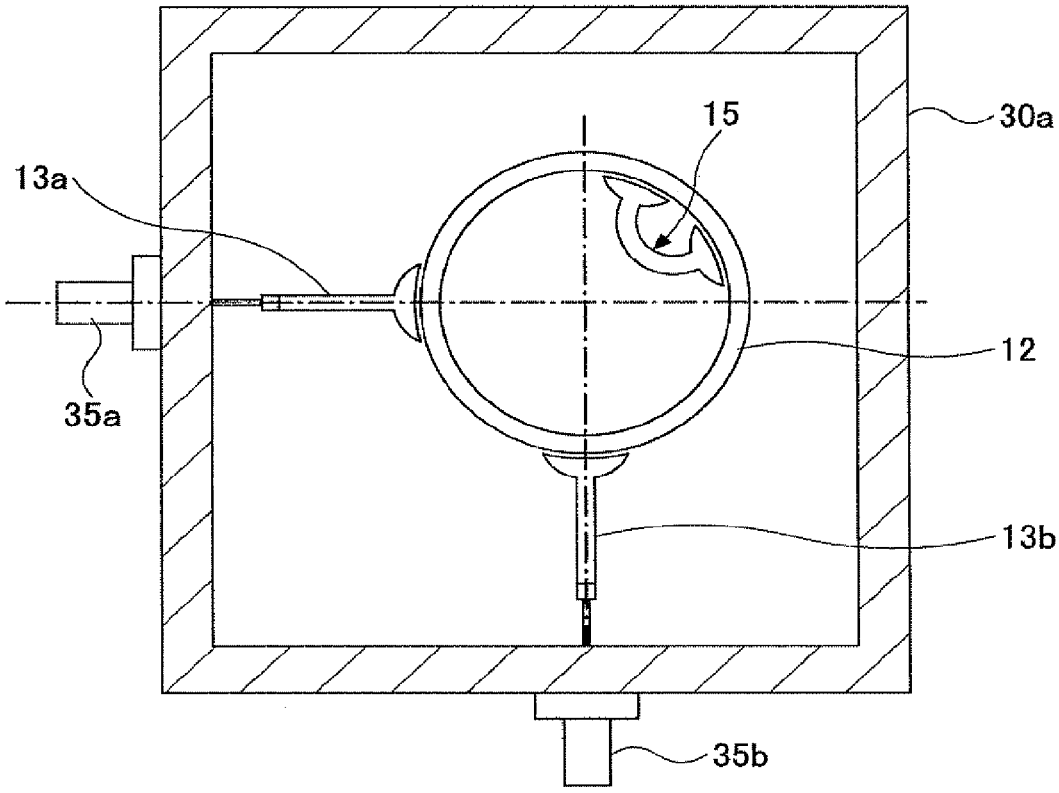

FIGS. 3A and 3B are cut-open views schematically showing a dual-mode filter according to the first embodiment of the present invention packaged to constitute a high-frequency filter apparatus 10 (FIG. 3A). As shown in FIGS. 3A and 3B, the ring resonator 12, the input feeder 13*a*, the output feeder 13*b* (FIG. 3B), and the dual-mode generating line 15 (FIG. 3B) are formed in the same plane on a dielectric substrate 11 (FIG. 3A). Further, a ground film 14 (FIG. 3A) is formed on the opposite (rear) side of the dielectric substrate 11, configuring a so-called micro-strip structure. However, the present invention is not limited to this structure. Any other transmission line structure such as a so-called triplate structure where the ring resonator 12, the input feeder 13*a*, the output feeder 13*b*, and the dual-mode generating line 15 are sandwiched by upper and lower ground films may be used without changing or altering the nature or departing from the scope of the present invention.

The high frequency filter apparatus 10 may be used as a 5-GHz band-pass filter. In the high frequency filter apparatus 10, the electrical length of the ring resonator 12 is designed to correspond to the carrier wavelength of a desired frequency in the frequency band; and the ring resonator 12 is formed of a high conductive material or a superconductive material. Since surface resistance of a superconductive material is very low even in a high frequency range, it is advantageous to use such superconductive material to produce a low-loss and high-Q resonator. In such a case, as a superconductive material, for example, YBCO (Y—Ba—Cu—O), RBCO(R—Ba—Cu—O; as the "R" element, Nd, Gd, Sm, or Ho may be used instead of Y), BSCCO (Bi—Sr—Ca—Cu—O), PBSCCO (Pb—Bi—Sr—Ca—Cu—O), or CBCCO (Cu—$Ba_p$—$Ca_q$—$Cu_r$—$O_x$: $1.5<p<2.5$, $2.5<q<3.5$, $3.5<r<4.5$) may be used. The input feeder 13*a*, the output feeder 13*b*, and the dual-mode generating line 15 can be formed of the same superconductive material as that of the ring resonator 12 and in the same processes as those of the ring resonator 12.

In a specific method of producing the dual-mode filter, YBCO superconducting thin films each having a thickness of 100 nm are formed on both sides of an MgO dielectric substrate 11 having a thickness of 0.5 mm and exposing (100) crystal planes. A ground surface 14 is formed on one of the two YBCO superconducting thin films, and the ring resonator 12, the input feeder 13*a*, the output feeder 13*b*, and the dual-mode generating line 15 are patterned on the other YBCO superconducting thin film by photolithography and wet etching processes.

The dielectric substrate 11 on which patterns of such a resonator are formed is accommodated in a package main body 30*a* and sealed with an upper cover 30*b* (FIG. 3A). The package 30 (FIG. 3A) including the package main body 30*a* and the upper cover 30*b* may be a gold-plated copper shield case. The ground surface 14 on the rear side of the dielectric substrate 11 is in contact with a bottom surface of the package main body 30*a*. The input feeder 13*a* and the output feeder 13*b* are connected to an input connector 35*a* and an output connector 35*b* (FIG. 3B), respectively, through corresponding connecting electrodes (not shown) by, for example, Au wire boding. A connector cable (not shown) is connected to and extended from each of the input connector 35*a* and the output connector 35*b*. When a superconductive material is used for the ring resonator 12 and the like, each package 30 including a high frequency filter is to be held in place in a vacuum cooled chamber.

Figure 4A:
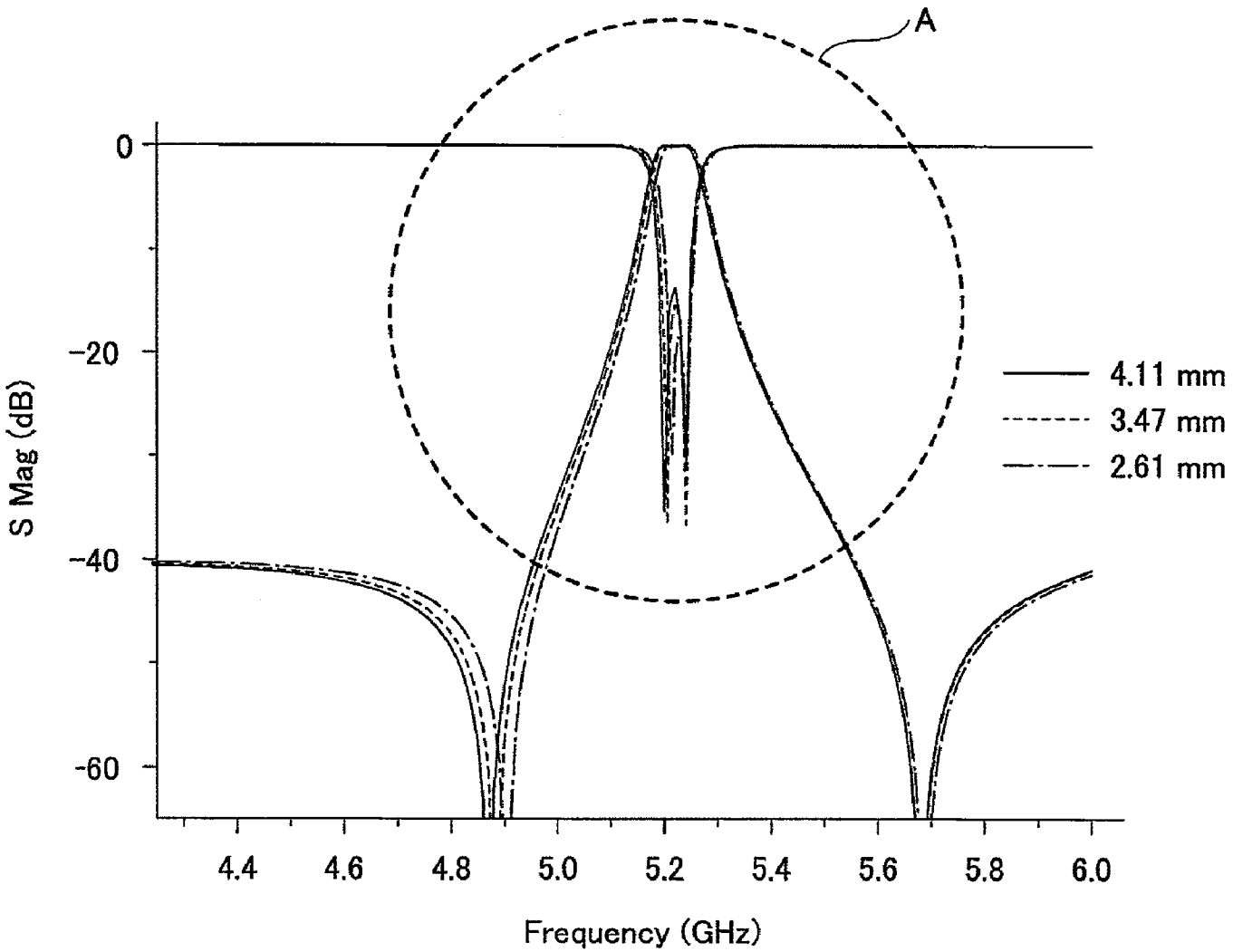
FIG. 4A is a graph showing changes of the filter characteristics responsive to the change of a waveguide length of the dual-mode generating line.
Figure 4B:
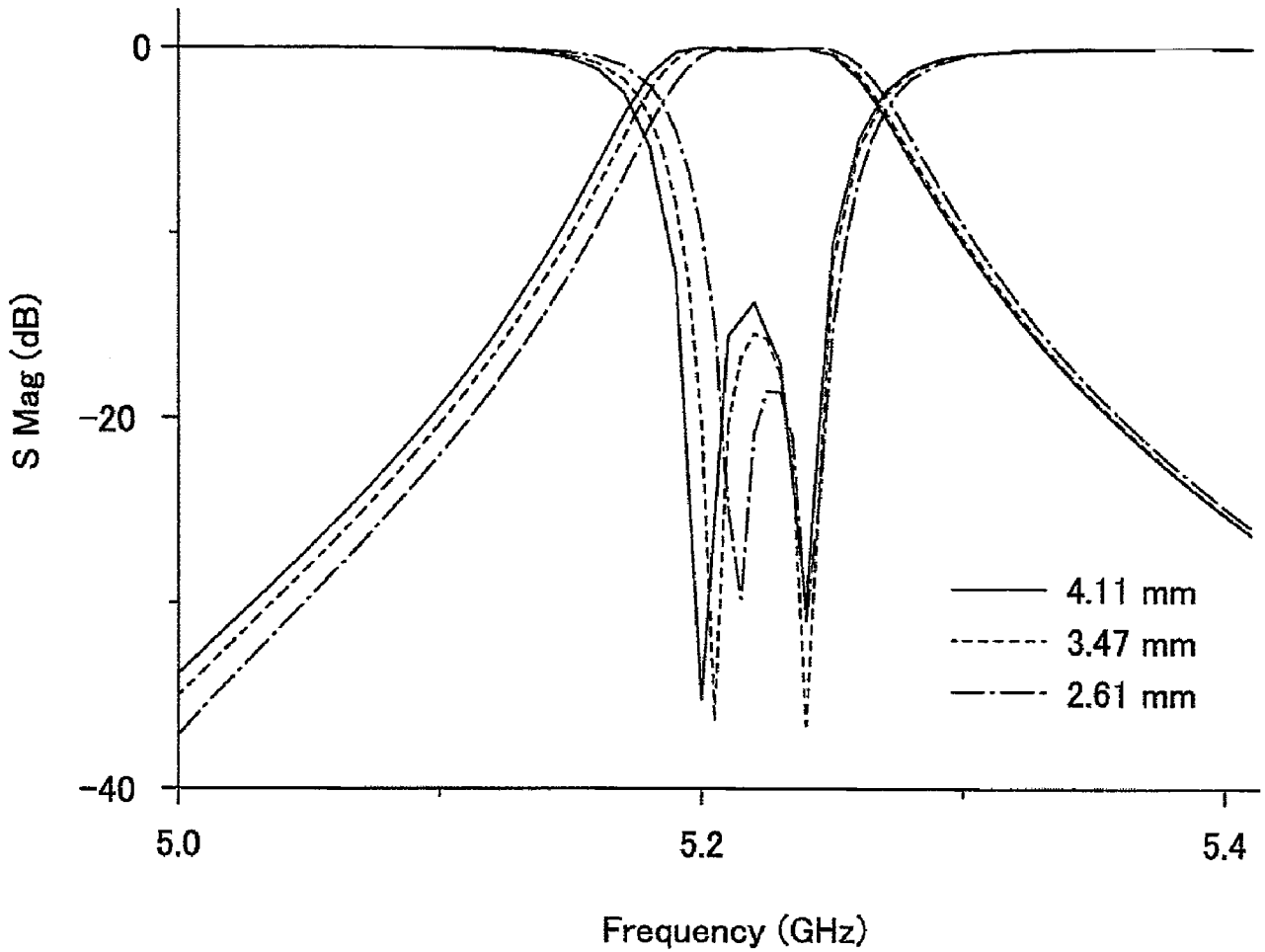
FIG. 4B is an enlarged graph of a circled area "A" in FIG. 4A.

FIGS. 4A and 4B are graphs of simulation results showing changes of the filter characteristics (S Mag (dB)/frequency (GHz)) responsive to the change of the waveguide length of the dual-mode generating line 15 in the ring resonator 12 shown in FIG. 1. FIG. 4B is an enlarged graph of a circled area "A" shown in FIG. 4A.

In the simulation, the open angle between the ring resonator 12 radii passing through the first port 15*a* and the second port 15*b* of the dual-mode generating line 15 with respect to the center of the ring resonator 12 is 45 degrees, and the positions of the first port 15*a* and the second port 15*b* of the dual-mode generating line 15 with respect to the ring resonator 12 are also fixed so that the angle "θ" is 45 degrees as shown in FIG. 1A. Then, the length of the waveguide 15*c* is varied as 2.61 mm (0.115λ), 3.47 mm (0.153λ), and 4.11 mm (0.182λ) as shown in FIG. 4B. Each of the lengths of the waveguide 15*c* is nearly λ/8 and less than λ/4. It should be noted that the radius and the line width of the ring resonator 12 formed of YBCO are 3.5 mm and 0.5 mm, respectively. According to the results shown in FIG. 4A, in each of the lengths of the waveguide 15*c*, a dual-mode and attenuation poles are generated, thereby obtaining sharp frequency cut-off characteristics.

Further, as the enlarged graph in FIG. 4B shows, both the center frequency and the bandwidth can be adjusted by changing the length of the waveguide 15*c*. More specifically, when two different resonant frequencies generated in a dual-mode are given as "f1" and "f2" ("f1"<"f2"), the peak position of the higher frequency "f2" is substantially unchanged, but the peak position of the lower frequency "f1" is shifted to the lower frequency side as the length of the waveguide 15*c* is increased.

Figure 5:
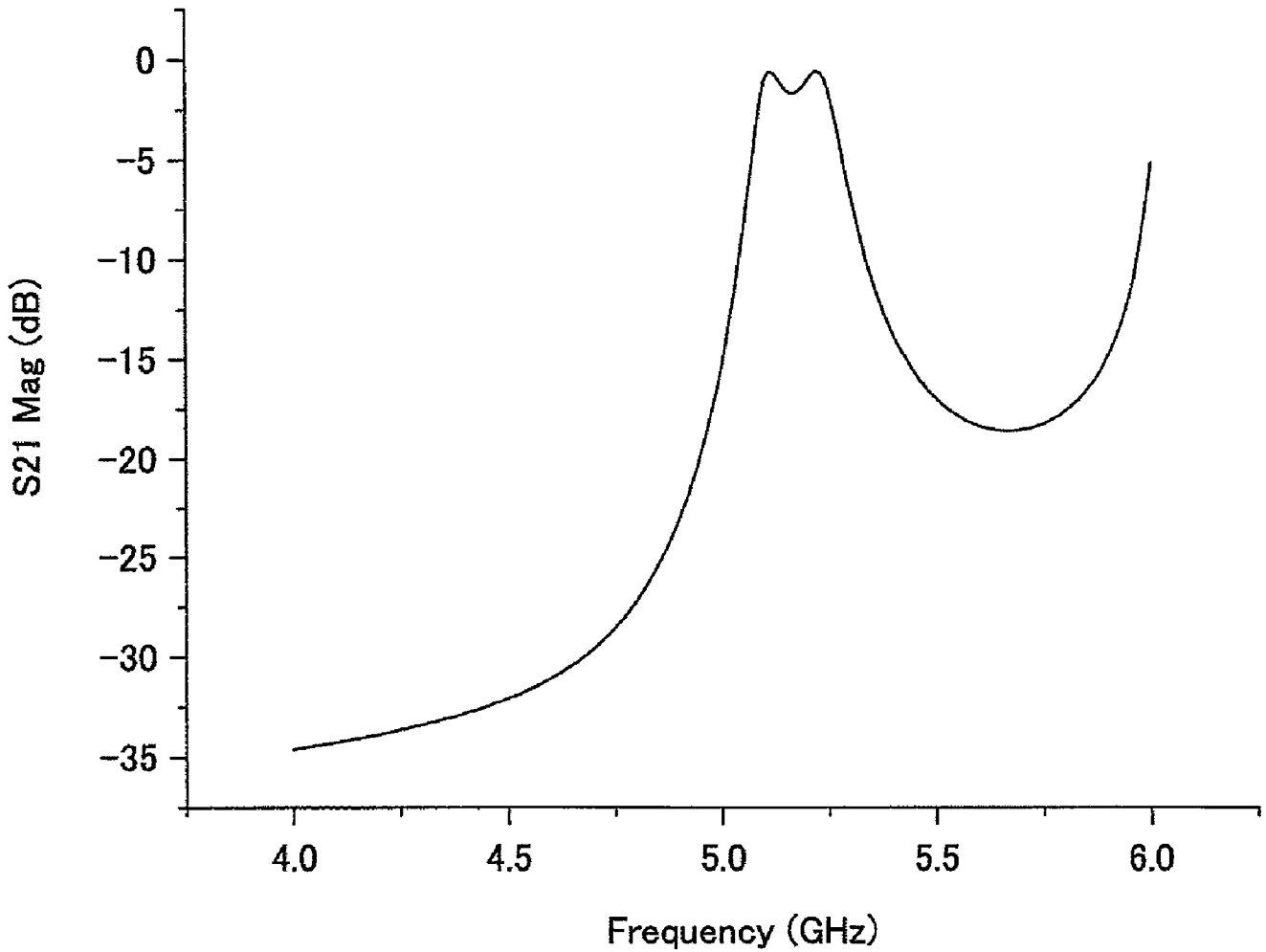
FIG. 5 is a graph showing a comparative example where the electrical length of the dual-mode generating line is set to $\lambda/4$.

FIG. 5 is a graph (S21 Mag (dB)/frequency (GHz)) showing a comparative example where the open angle between the first port 15*a* and the second port 15*b* of the dual-mode generating line 15 with respect to the center of the ring resonator is 90 degrees: namely the electrical length "Leq" is λ/4. As shown in FIG. 5, no attenuation pole is generated and an undesired resonance is generated unlike the characteristics shown in FIGS. 4A and 4B. Therefore, preferably, it is suggested that the electrical length "Leq" of the dual-mode generating line 15 be less than λ/4 to effectively pass a desirable frequency. However, when the electrical length "Leq" of the dual-mode generating line 15 is too short, parasitic capacitance is generated due to there being too short a distance between the ring resonator 12 and the dual-mode generating line 15, which may begin to resonate with each other. As a result, preferably, the electrical length "Leq" of the dual-mode generating line 15 is equal to or more than λ/10 and less than λ/4.

Figure 6:
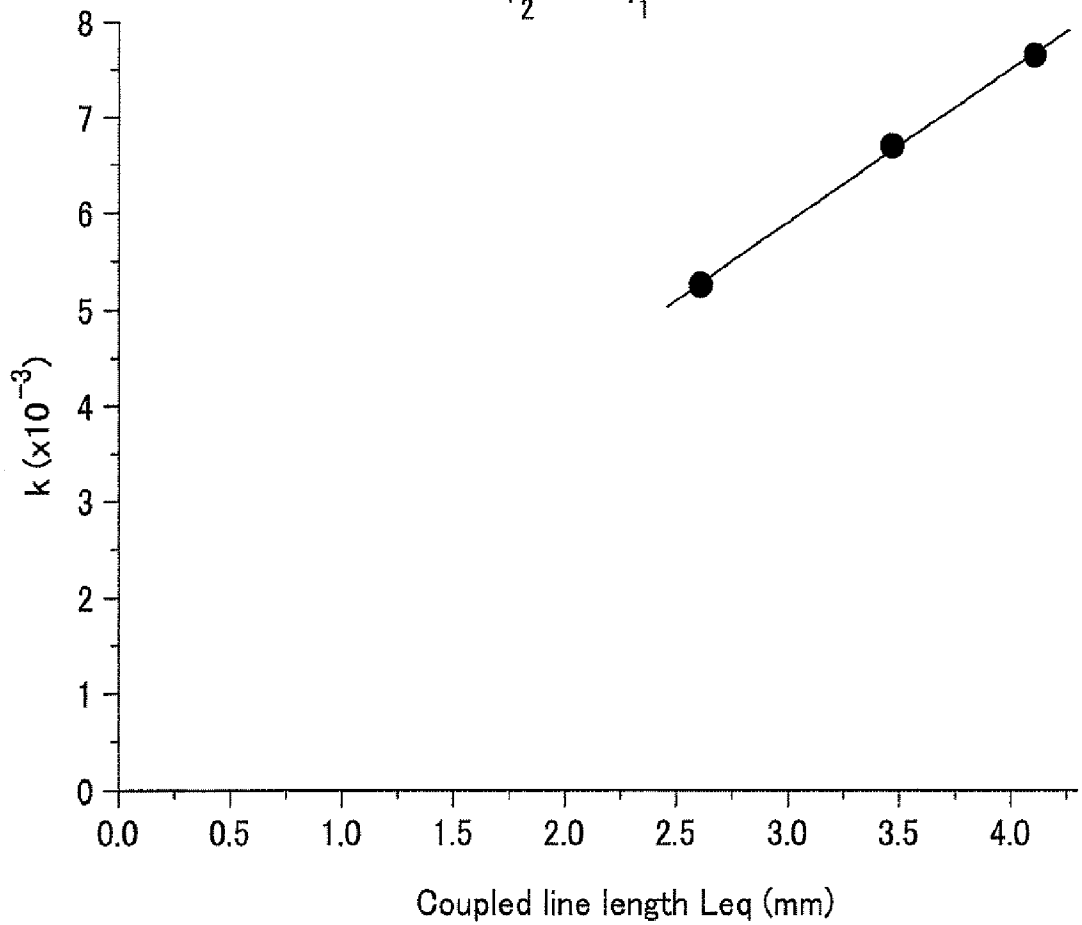
FIG. 6 is a graph showing changes of a coupling coefficient responsive to the change of the waveguide length of the dual-mode generating line.

FIG. 6 is a graph of simulation results showing changes of a coupling coefficient "k" responsive to the change of the waveguide length (coupled line length (mm)) "Leq". Herein, the coupling coefficient "k" is given as follows:

$$k=(\text{“}f2\text{”}^2-\text{“}f1\text{”}^2)/(\text{“}f2\text{”}^2+\text{“}f1\text{”}^2)$$

where reference symbols "f1" and "f2" denote resonant frequencies generated in the dual-mode ("f1"<"f2").

As shown in FIG. 6, the coupling coefficient "k" increases as the waveguide length "Leq" increases. When the coupling coefficient "k" increases, the coupling between the two mutual orthogonal resonant modes is reinforced, thereby broadening the frequency band between the resonant modes, namely making the pass-band characteristics wider (characteristics on the lower frequency side are further shifted to the lower frequency side). Therefore, desirable filter characteristics can be realized by selecting the electrical length "Leq" of the dual-mode generating line 15 in the design stage of the filter.

Figure 7:
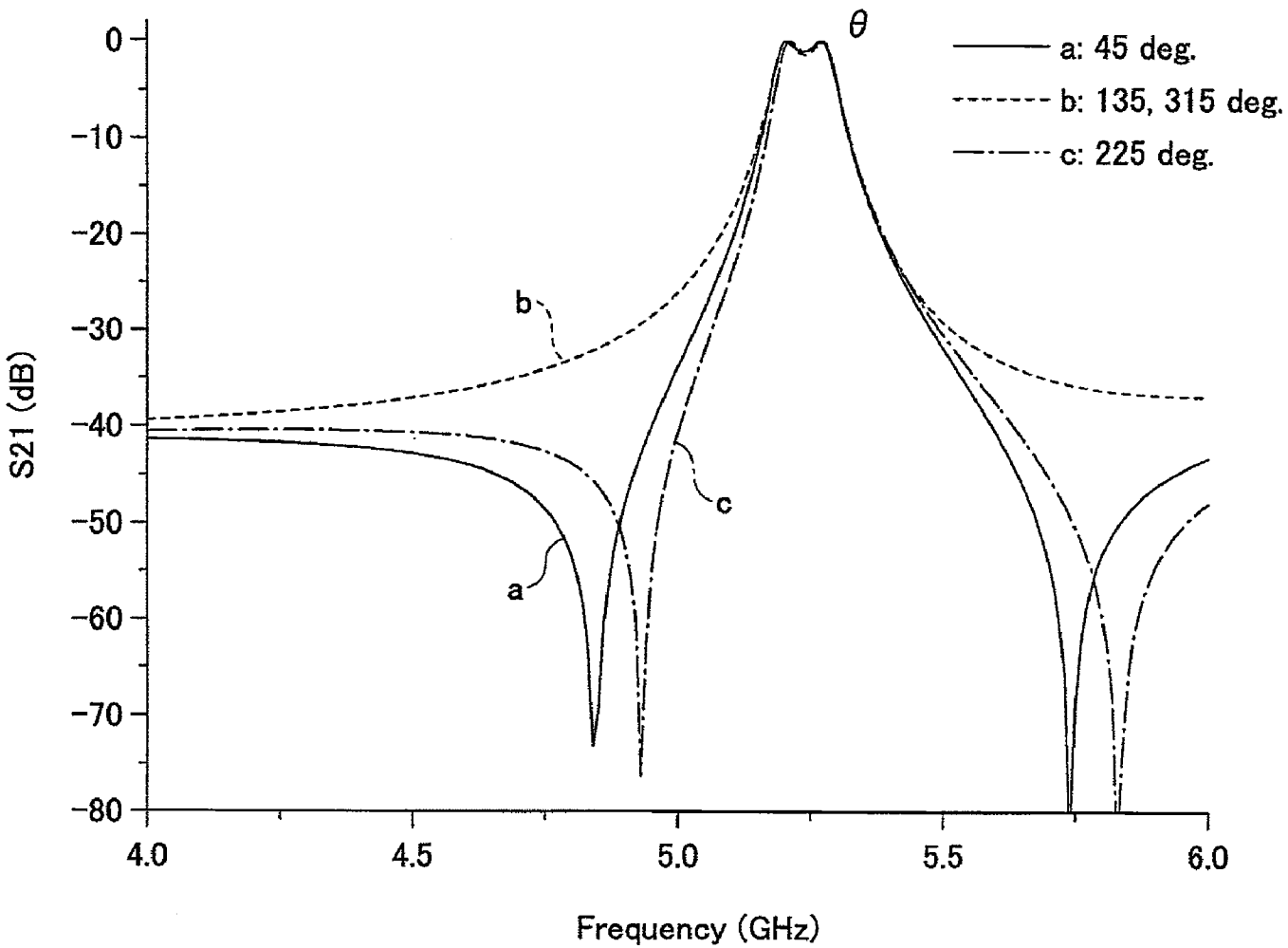
FIG. 7 is a graph showing changes of the filter characteristics responsive to the change of the position of the dual-mode generating line.

FIG. 7 is a graph (S21 (dB)/frequency (GHz)) of simulation results showing changes of the filter characteristics responsive to the change of the position of the dual-mode generating line 15. In the simulation, the conditions are the same as those in the simulation shown in FIGS. 4A and 4B except the position of the dual-mode generating line 15. More specifically, the position is changed by sequentially setting the "θ" to 45 degrees, 135 degrees, 225 degrees, and 315 degrees as shown in FIG. 7. The curved solid line "a" represents the filter characteristics when the angle "θ" is 45 degrees. The curved chain line "c" represents the filter characteristics when the angle "θ" is 225 degrees (45 degrees+n). The curved dotted line "b" represents the filter characteristics when the angle "θ" is 135 degrees or 315 degrees. In any case, the dual-mode generating line 15 is disposed so as not to overlap the lines "X" and "Y" extending from the input feeder 13*a* and the output feeder 13*b*, respectively.

As FIG. 7 shows, the degree of freedom in positioning the dual-mode generating line 15 is extremely high. However, it is desirable to dispose the dual-mode generating line 15 so that the angle "θ" is 45 degrees or 225 degrees, namely 45 degrees+n (n=0, 1, 2, . . . ), when it is required to eliminate frequency components adjacent to a desired frequency.

Figure 8A:
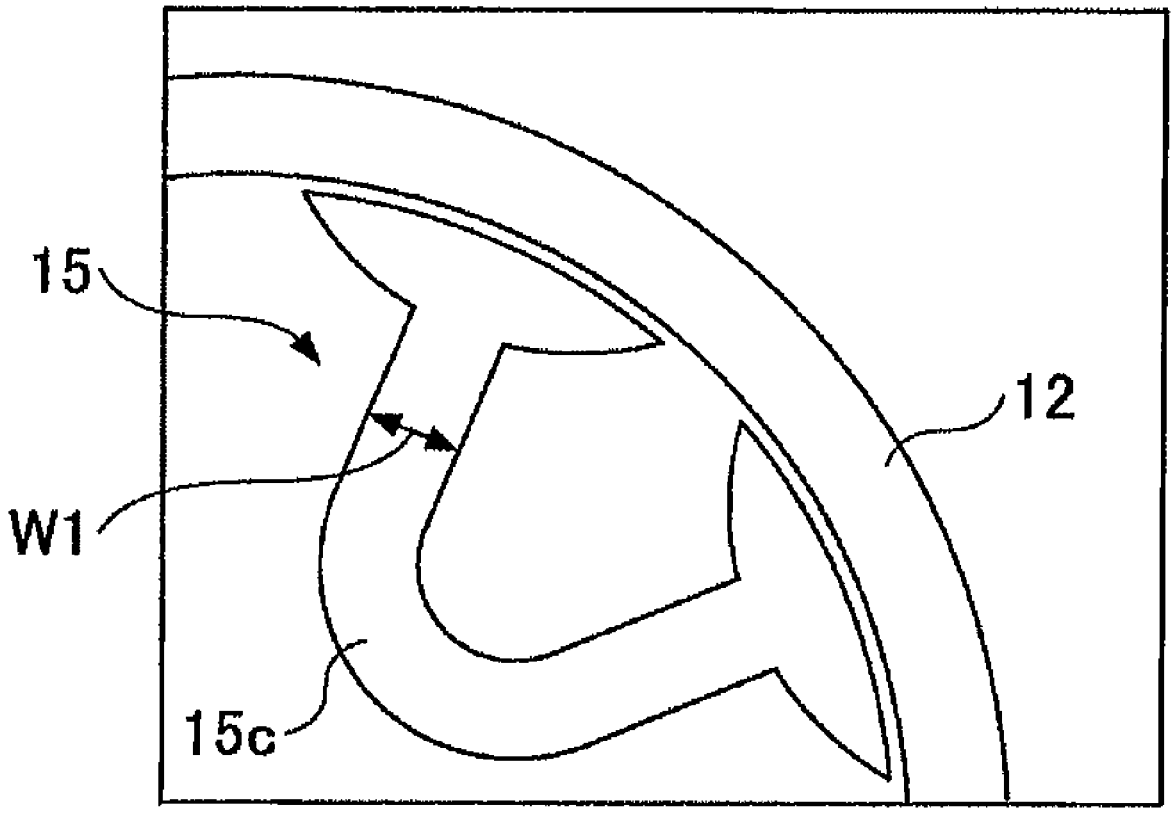
FIG. 8A is a partially enlarged view showing a line width "W1" of the dual-mode generating line.
Figure 8B:
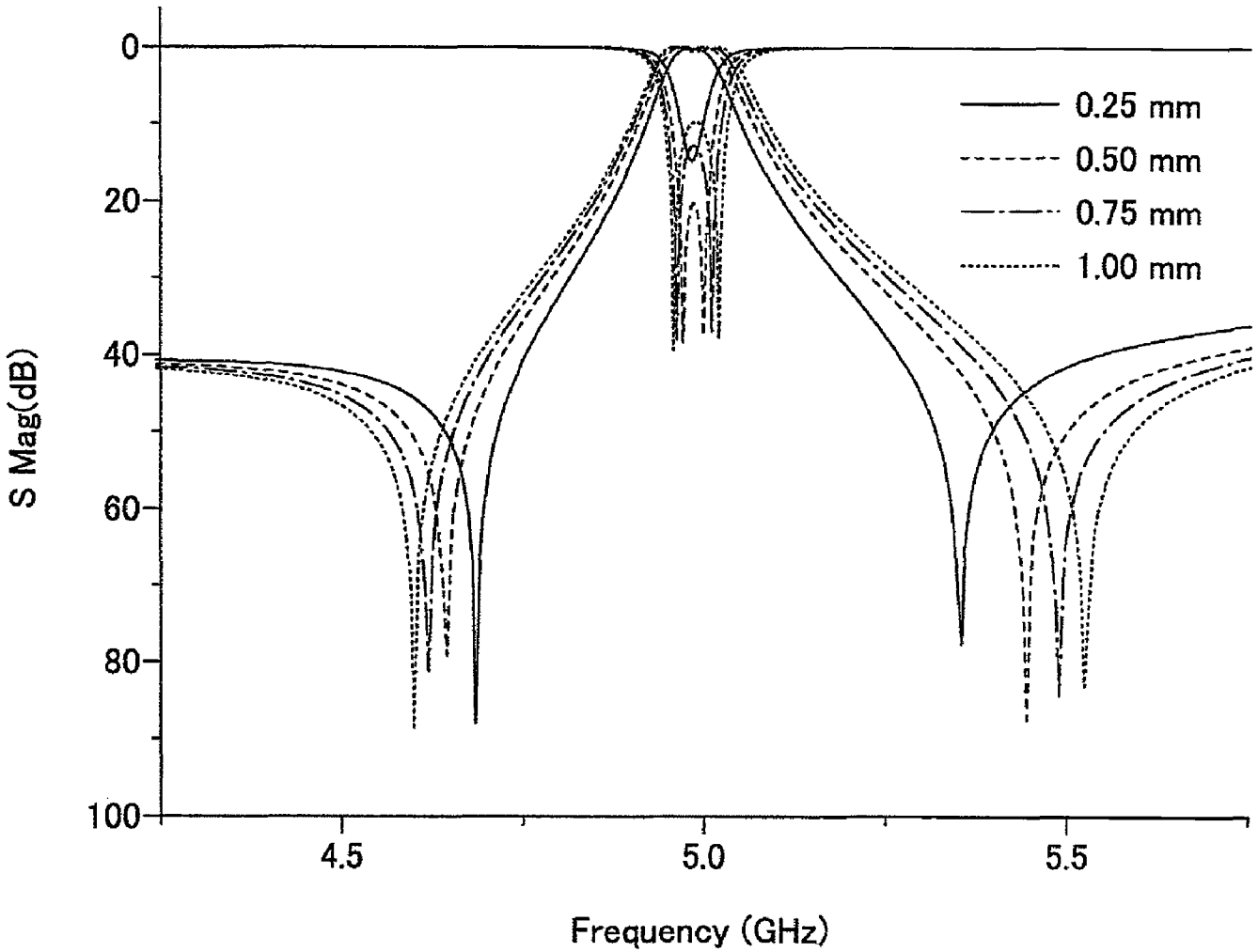
FIG. 8B is a graph showing changes of the filter characteristics responsive to the change of the line width of the dual-mode generating line.

FIG. 8B is a graph (S Mag (dB)/frequency (GHz)) of simulation results showing changes of the filter characteristics responsive to the change of the line width "W1" of the dual-mode generating line 15 as shown in FIG. 8A. As shown in FIG. 8A, the dual-mode filter includes the ring resonator 12 and the dual-mode generating line 15, which includes the waveguide 15*c*. In the simulation, while the electrical length "Leq" in the dual-mode generating line 15 is 6.00 mm, when the line width "W1" is sequentially changed to 0.25 mm, 0.50 mm, 0.75 mm, and 1.00 mm as shown in FIG. 8B, the transmission characteristics of the filter change in a manner so as to broaden the bandwidth as shown in FIG. 8B.

Figure 9A:
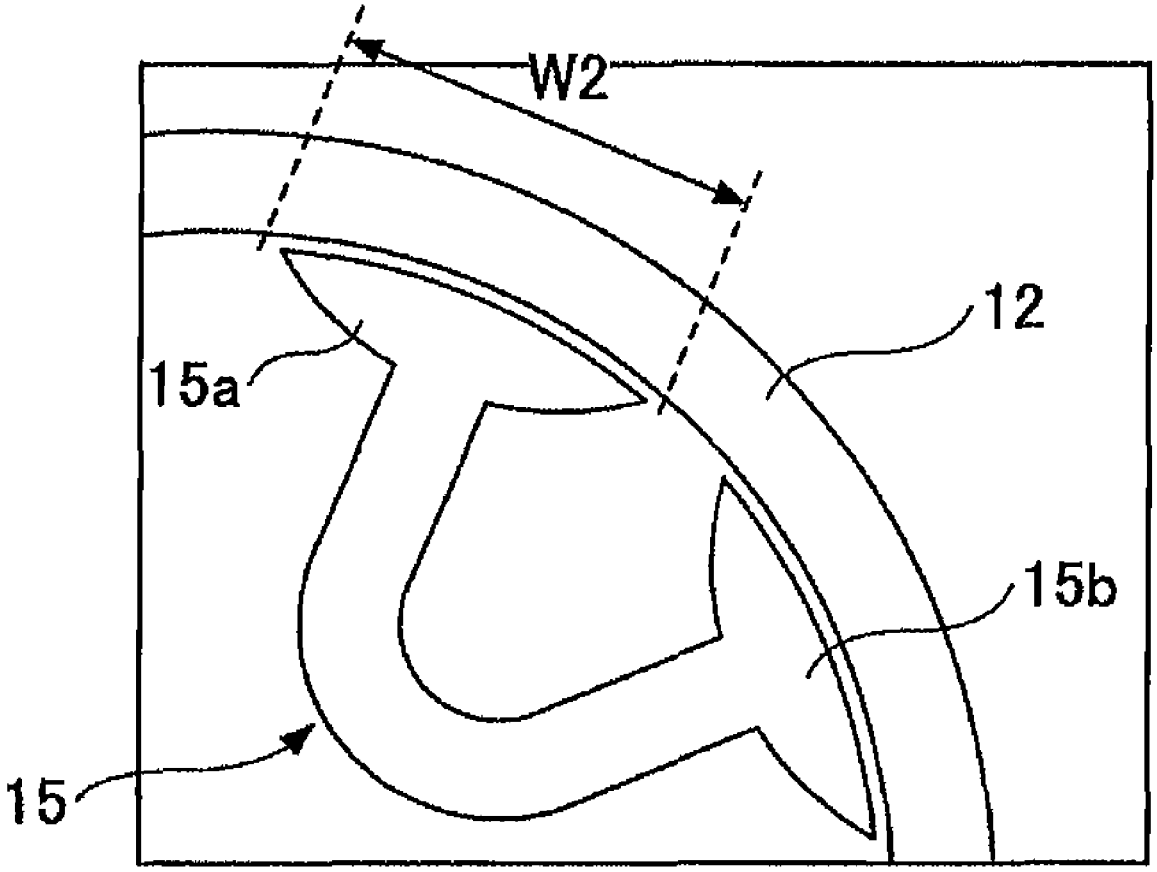
FIG. 9A is a partially enlarged view showing a coupling amount between the dual-mode generating line and the ring resonator (namely a coupling width "W2" of the dual-mode generating line)
Figure 9B:
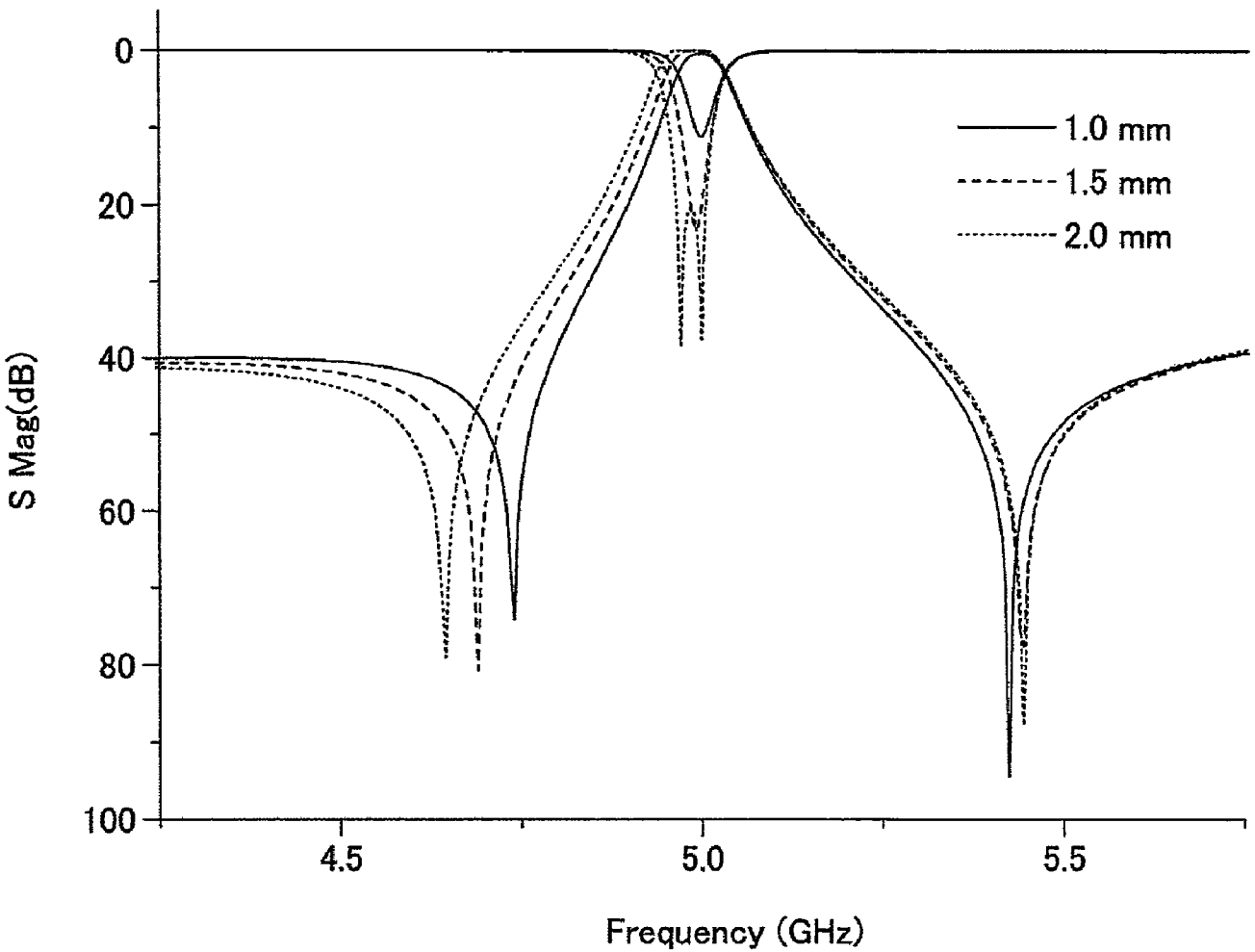
FIG. 9B is a graph showing changes of the filter characteristics responsive to the change of the coupling amount (namely the coupling width "W2")

FIG. 9B is a graph (S Mag (dB)/frequency (GHz)) of simulation results showing changes of the filter characteristics responsive to the change of a coupling amount between the dual-mode generating line 15 and the ring resonator 12 by changing the coupling width "W2" of the dual-mode generating line 15 as shown in FIG. 9A. As shown in FIG. 9A, the dual-mode filter includes the ring resonator 12 and the dual-mode generating line 15. As shown in FIG. 9A, the coupling width "W2" is the width of the coupling area where the first port 15*a* (or the second port 15*b*) faces the ring resonator 12. In this example, the electrical length "Leq" in the dual-mode generating line 15 is 6.00 mm, and as shown in FIG. 9A, the gap between the first port 15*a* (or the second port 15*b*) and the ring resonator 12 is 75 μm. When the coupling width "W2" is sequentially changed to 1.0 mm, 1.5 mm, and 2.0 mm, though the change of characteristics on the higher frequency side is limited, the characteristics on the lower frequency side are shifted further to the lower frequency side, thereby making the pass band wider.

As described above, when at least one of the electrical length "Leq", the line width "W1", and the coupling amount between the dual-mode generating line 15 and the ring resonator 12 (for example, the coupling width "W2") can be changed, it is possible to design the filter having the desired filter characteristics.

Figure 10:
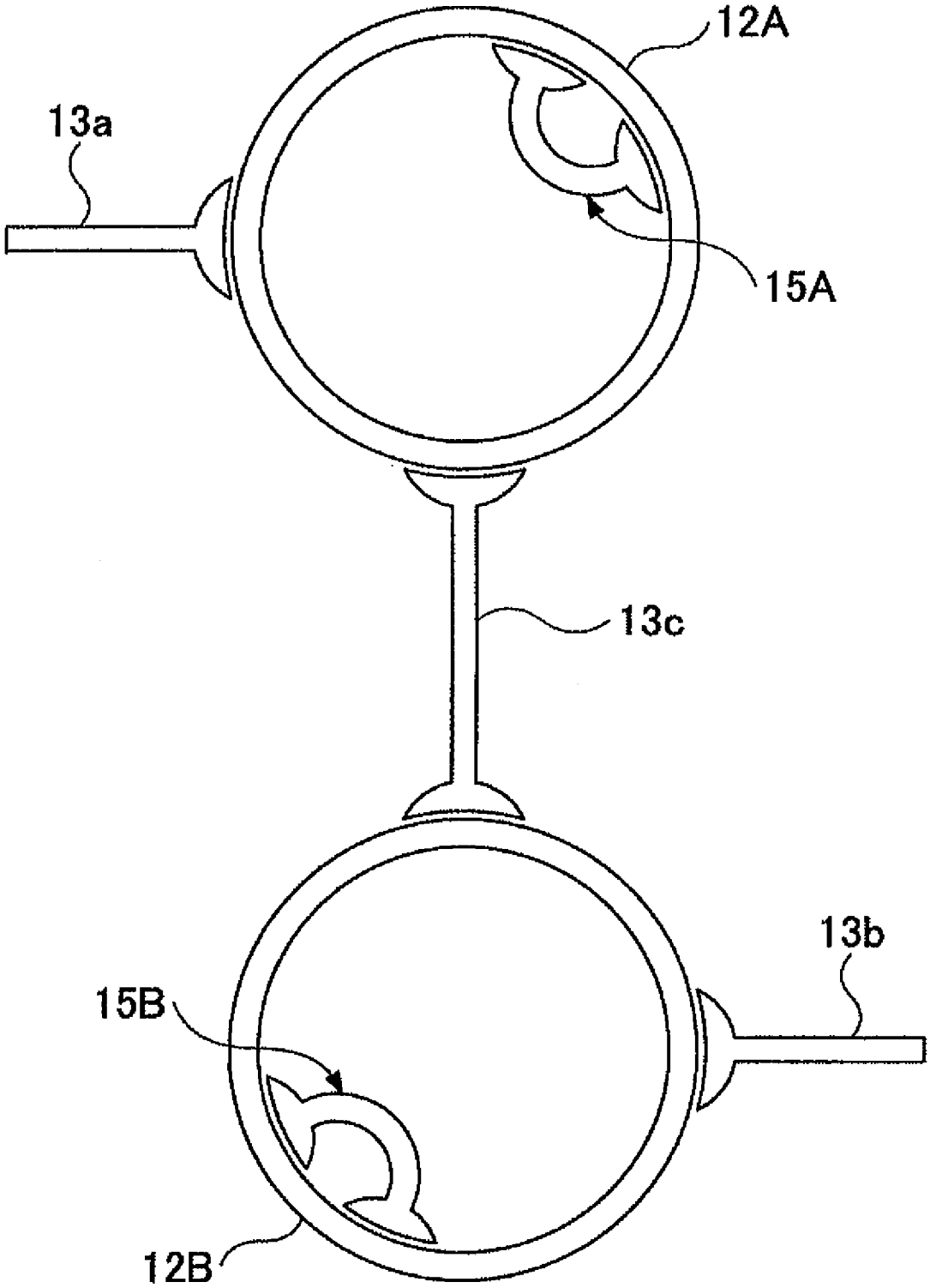
FIG. 10 is a view showing an exemplary configuration of a multistage filter including plural (two) ring resonators shown in FIG. 1.

FIG. 10 shows an exemplary configuration of a multistage filter including plural (two) ring resonators shown in FIG. 1. As shown in FIG. 10, the multistage filter includes a first ring resonator 12A, a second ring resonator 12B and a coupling line 13*c*. The first ring resonator 12A and the second ring resonator 12B are electromagnetically coupled to each other via the coupling line 13*c*. The first ring resonator 12A includes a dual-mode generating line 15A and an input feeder 13*a*. The second ring resonator 12B includes a dual-mode generating line 15B and an output feeder 13*b*. The first ring resonator 12A and the second ring resonator 12B are symmetrical with each other with respect to the center of the coupling line 13*c*.

From the viewpoint of ring resonator 12A, the coupling line 13*c* serves as the output feeder of the ring resonator 12A; and from the viewpoint of ring resonator 12B, the coupling line 13*c* serves as the input feeder of the ring resonator 12B. Because of this feature, space efficiency is improved when plural ring resonators each having the same configuration of resonator as shown in FIG. 1A are connected to each other. Further, as shown in FIG. 10, when the first ring resonator and the second ring resonator have a point-symmetrical relationship with each other, an attenuation pole having sharp attenuation characteristics is obtained at each side of the pass band, thereby realizing a filter having sharp frequency cut-off characteristics. It should be noted that in a multistage filter including three or more ring resonators, a dual-mode filter having sharp frequency cut off characteristics can be realized by connecting two adjacent ring resonators in a manner so that the two adjacent ring resonators have a point-symmetrical relationship with each other. Further, each dual-mode generating line 15 is formed inside the corresponding ring resonator 15. Because of this structure, the space efficiency is further improved as the number of ring resonators in a multistage filter increases; and the structure of the multistage filter is advantageous in reducing the size of the filter.

Figure 11:
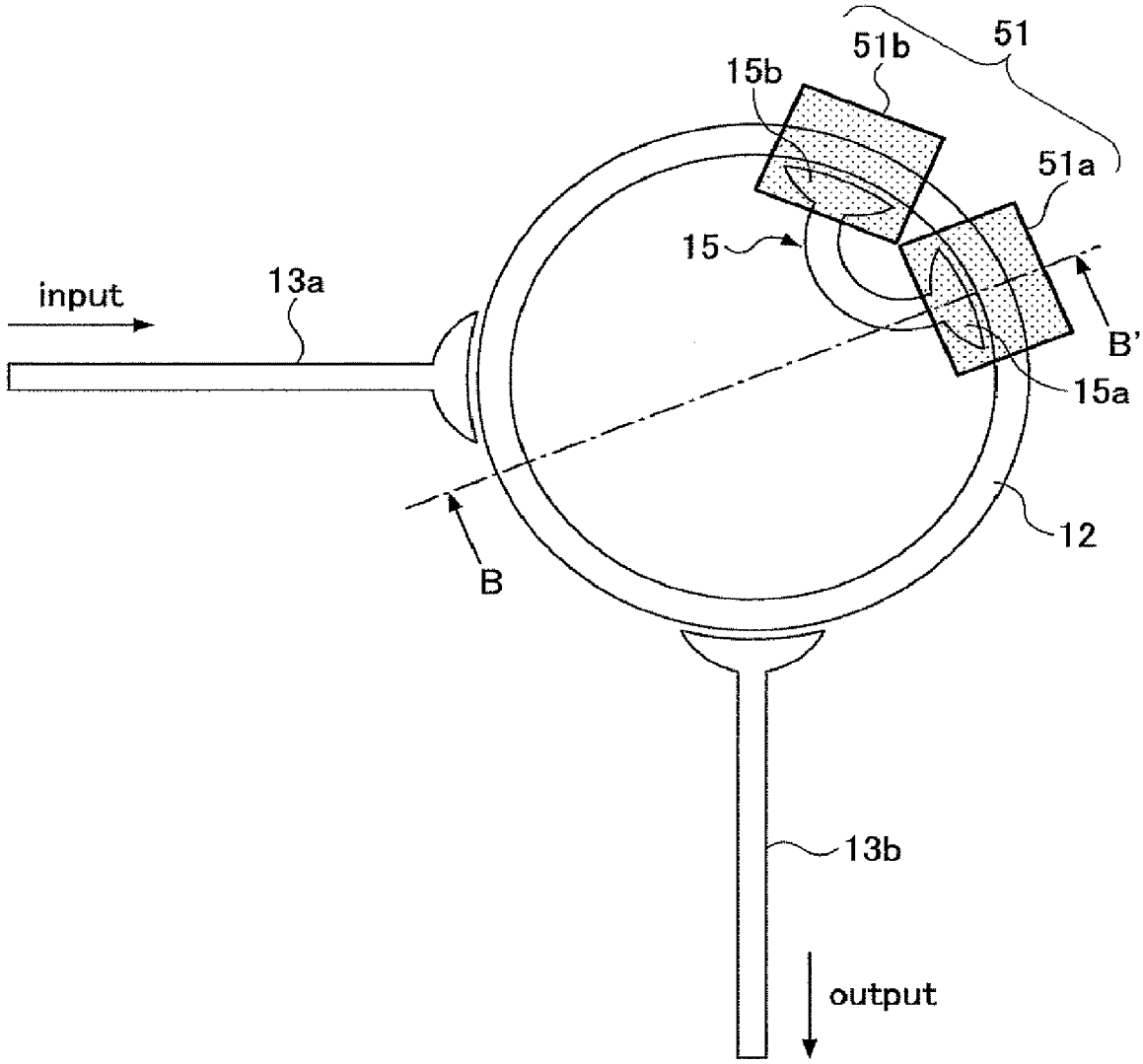
FIG. 11 is a plan view schematically showing a configuration of a dual-mode resonant filter according to a second embodiment of the present invention.

FIG. 11 is a schematic view showing a dual-mode filter according to a second embodiment of the present invention for a high-frequency filtering device. As shown in FIG. 11, the dual-mode filter includes the ring resonator 12, the input feeder 13*a* ("input"), the output feeder 13*b* ("output"), and the dual-mode generating line 15, which includes the first port 15*a* and the second port 15*b*. According to the first embodiment of the present invention, filter characteristics can be adjusted by adjusting at least any one of the wavelength of the dual-mode generating line 15, the line width "W1", and the coupling amount (namely, coupling width "W2") in the design stage. However, even when the dual-mode generating line 15 is designed in accordance with a desired signal wavelength (frequency), the products actually produced may have variations due to patterning errors and thickness variations of the dielectric substrate 11. To respond to the problem, it is necessary to perform fine adjustments to control the variations of the characteristics of the products.

In a dual-mode filter according to the second embodiment of the present invention, there is provided a dielectric block above at least one of electromagnetic coupling points "C1" and "C2" between the dual-mode generating line 15 and the ring resonator 12 (see FIG. 1B). Further, the dielectric block is movable in the vertical direction with respect to the dual-mode generating line 15 and the ring resonator 12, thereby enabling the fine adjustment of the filter characteristics after a patterning process.

In an example in FIG. 11, the dielectric blocks 51*a* and 51*b* are disposed above the coupling points "C1" and "C2", respectively. In this example, rectangular-solid shaped (rectangular-shaped in plan view) dielectric blocks 51*a* and 51*b* are used. However, the shape of the dielectric block is not limited to this shape. Any shape capable of being extended above the coupling point such as a cylindrical shape and an elliptical cylindrical shape may be used. As a material of the dielectric blocks 51*a* and 51*b* (generally referred to as 51), for example, MgO, $SrTiO_3$, $TiO_2$, or $Al_2O_3$ is used.

The dual-mode generating line 15 and the ring resonator 12 are formed in the same manner as those in the first embodiment; forming an epitaxial YBCO film by a sputtering method or a PLD method on both sides of the dielectric substrate 11 and patterning one side of the dielectric substrate 11 by photolithography and wet etching. Herein, as an example of a 5-GHz band-pass filter, a ring resonator 12 having a radius of 3.5 mm and a line width of 0.5 mm is formed on an MgO substrate 11 having a thickness of 0.5 mm.

Figure 12A:
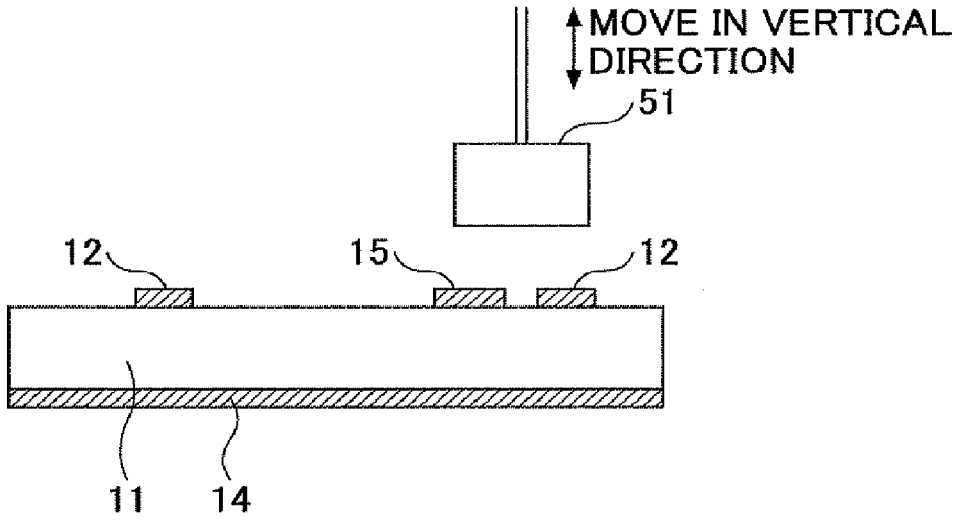
FIG. 12A is a cut-open view of the dual-mode filter in FIG. 11.

FIG. 12A is a cut-open view taken along a B-B' line in FIG. 11. As shown in FIG. 12A, the dielectric block 51 is disposed above the coupling point between the dual-mode generating line 15 and the ring resonator 12 that are formed on the dielectric substrate 11. The dielectric block 51 is movably supported in the substantially vertical direction with respect to the dual-mode generating line 15 and the ring resonator 12. In this configuration, it is possible to change the coupling capacitance between a port 15*a* or 15*b* and the ring resonator 12 by changing the height of the dielectric block 51 above the coupling points, thereby enabling the change of the coupling coefficient. As shown in FIG. 12A, the dual-mode filter includes a ground film 14.

Figure 12B:
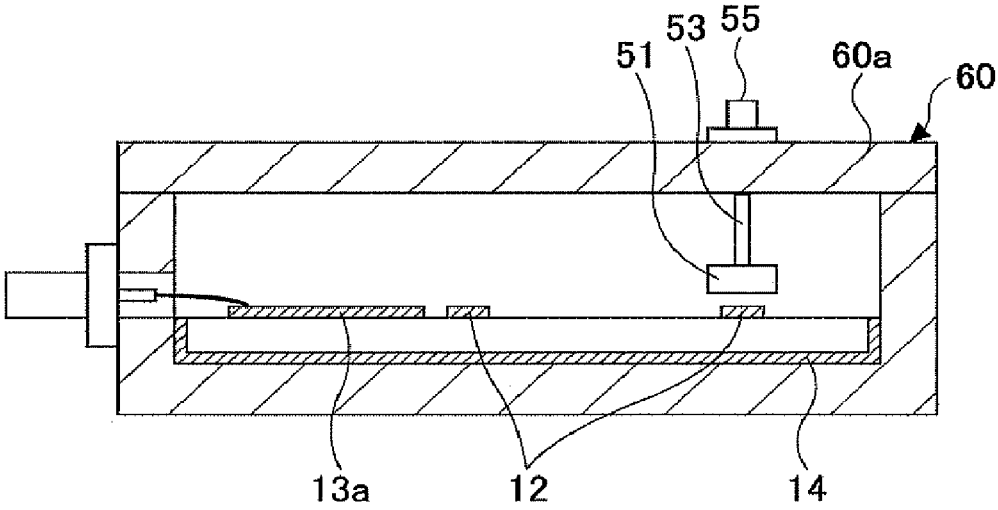
FIG. 12B is a cut-open view of the dual-mode filter in FIG. 11 accommodated in a package.

FIG. 12B is a cut-open view schematically showing a dual-mode filter and dielectric block 51 packaged as a high-frequency filter apparatus. As shown in FIG. 12B, the height of the dielectric block 51 can be adjusted by using a screw trimmer 55 mounted on an upper cover 60*a* of a package 60. In this case, the dielectric block 51 is held inside the package 60 by a supporting rod 53 connected to the trimmer 55. The configuration of the package is the same as that in the first embodiment except that the trimmer 55 is provided as a driving unit for moving the dielectric block 51. It should be noted that the driving unit for adjusting the height of the dielectric block 51 is not limited to this screw trimmer. For example, an actuator may be used. As shown in FIG. 12B, the dual-mode filter includes the ring resonator 12, the input feeder 13*a* and the ground film 14.

Figure 13A:
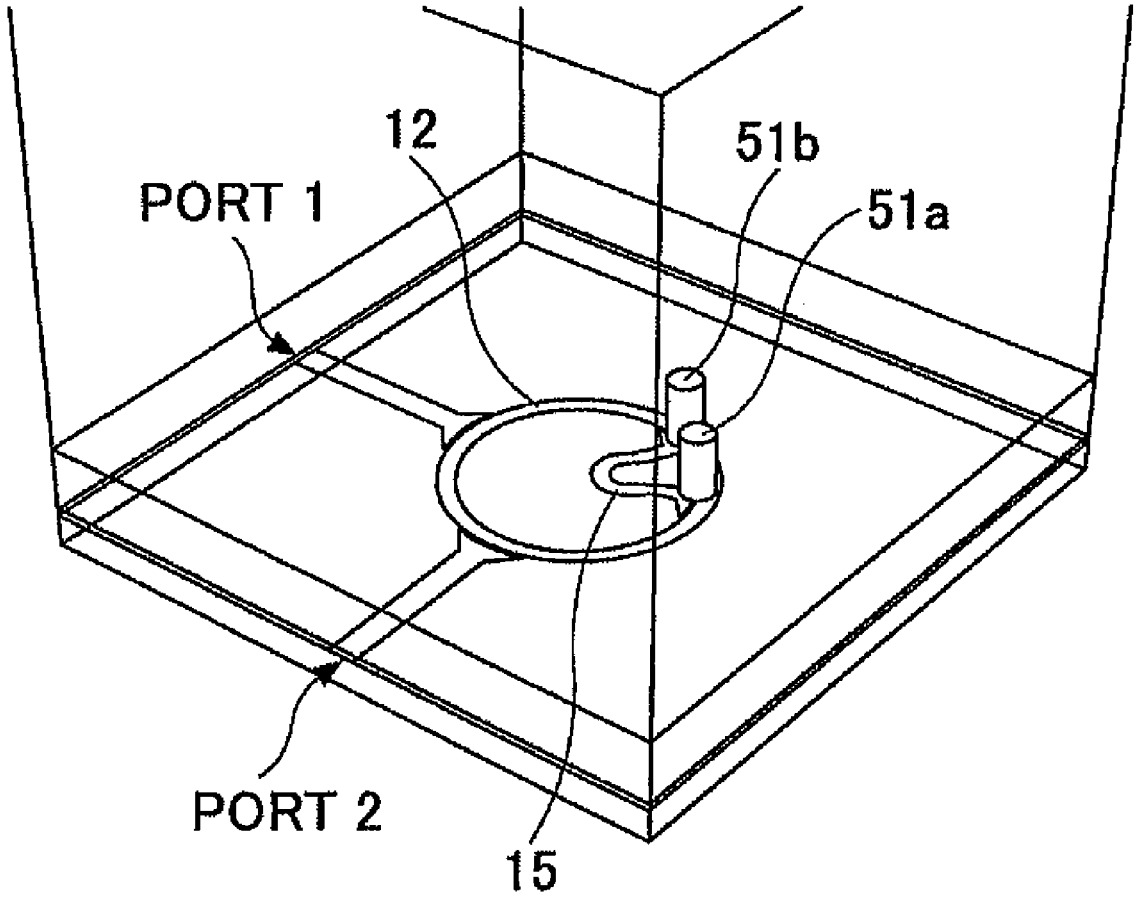
FIG. 13A is a perspective view schematically showing where dielectric blocks are disposed above the corresponding engaging areas between the dual-mode generating line and the ring resonator.
Figure 13B:
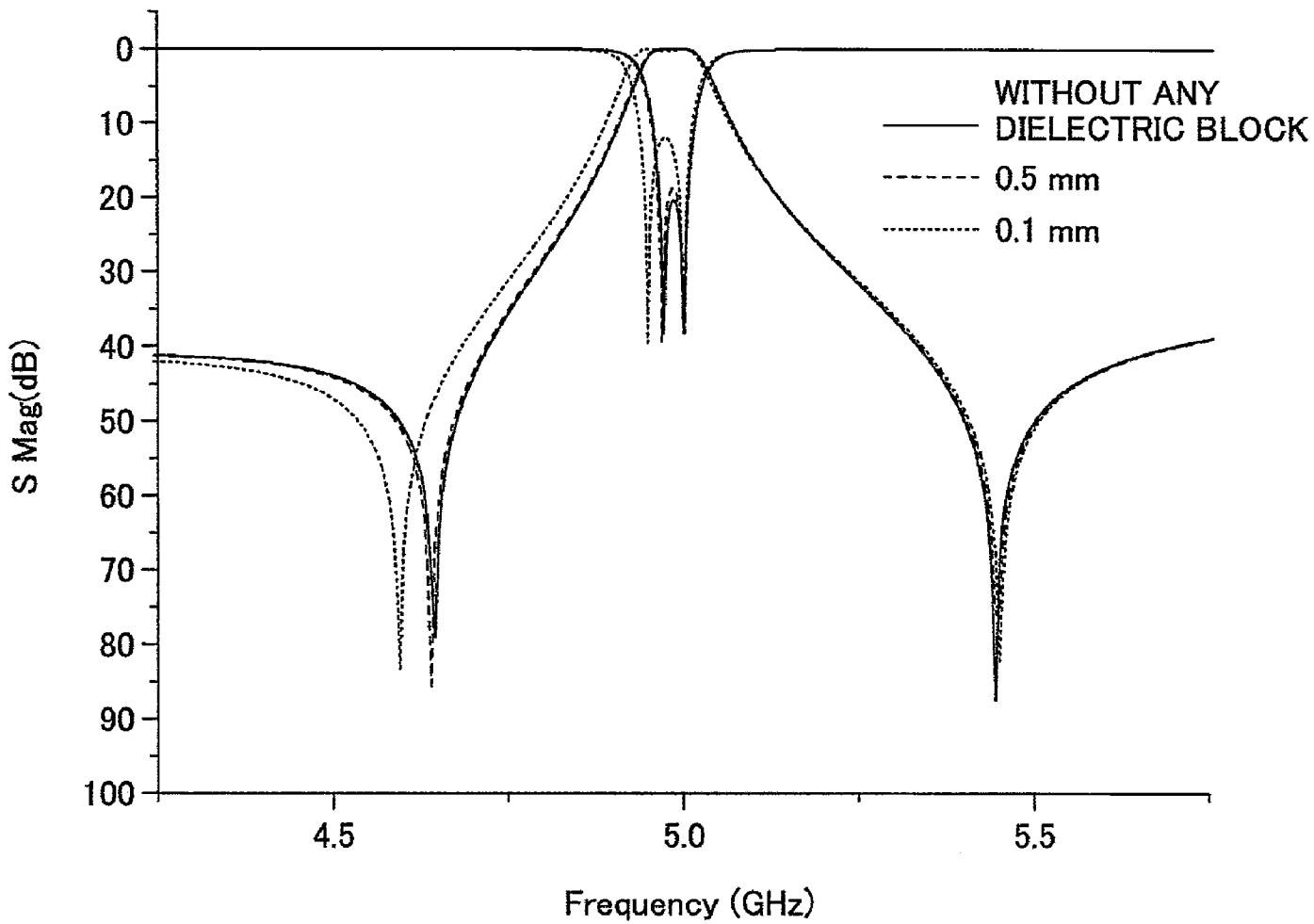
FIG. 13B is a graph showing filter characteristics responsive to the change of the height of the dielectric blocks.

FIG. 13A is a perspective view schematically showing where dielectric blocks 51*a* and 51*b* are disposed above the corresponding coupling points between the dual-mode generating line 15 and the ring resonator 12. As shown in FIG. 13A, the dual-mode filter includes a port 1 and a port 2. FIG. 13B is a graph (S Mag (dB)/frequency (GHz)) showing filter characteristics when the height of the dielectric blocks 51*a* and 51*b* is changed. In the configuration in FIG. 13A, each of the dielectric blocks 51*a* and 51*b* is made of a cylindrical-shaped single-crystal MgO block having a diameter of 0.5 mm and a height of 1 mm; the dielectric blocks 51*a* and 51*b* are disposed above the coupling points between the ports 15*a* and 15*b* and the ring resonator 12, respectively, as shown in FIG. 11. The filter characteristics are simulated by changing the height of the dielectric blocks 51*a* and 51*b*. As a comparative example, filter characteristics of a dual-mode filter without the dielectric blocks 51*a* and 51*b* is also simulated.

In the results of the simulation shown in FIG. 13B, it can be seen that the filter characteristics can be changed by changing the height of the dielectric blocks 51*a* and 51*b* with respect to the ring resonator 12 and the dual-mode generating line 15 in a range between 0.1 mm and 0.5 mm. Compared with the comparative example where no dielectric block 51 is disposed (solid line in the graph of FIG. 13B), as the dielectric block 51 approaches the ring resonator 12 and the dual-mode generating line 15 at a height ranging from 0.5 mm to 0.1 mm, the coupling coefficient is accordingly changed, thereby shifting the frequency characteristic on the lower frequency side to the lower frequency side.

It should be noted that the configuration as shown in FIG. 13A where the dielectric blocks 51*a* and 51*b* are above the corresponding electromagnetic coupling points between the dual-mode generating line 15 and the ring resonator 12 is also applied to, for example, the multistage filter in FIG. 10. In this case, advantageously, the variations of the filter characteristics among the plural ring resonators in a multistage filter can be controlled.

As described above, a dual-mode filter according to an embodiment of the present invention has sharp filter characteristics and a high degree of design freedom and/or tunability of the filter characteristics. Further, a fine adjustment of the filter characteristics can be easily performed with a simple configuration after a patterning process of the ring resonator.

What is claimed is:

1. A dual-mode filter comprising:

a ring resonator;

an input feeder and an output feeder disposed substantially orthogonal with respect to each other and with respect to the ring resonator so as to be electromagnetically coupled to the ring resonator; and a dual-mode generating line disposed inside the ring resonator in a manner so that the dual-mode generating line does not overlap either one of a line extending from the input feeder and a line extending from the output feeder, wherein a center of the dual-mode generating line is disposed in a manner so that an angle "θ" defined as an angle formed between a line passing through the center of the dual-mode generating line and a center of the ring resonator and a line extending from the input feeder is 45 degrees±90n degrees (n=0, 1, 2, 3), and the dual-mode generating line includes first and second ports each electromagnetically coupled to the ring resonator, and an arc-shaped waveguide connected between the first port and the second port, wherein a length of the dual-mode generating line between coupling points each electromagnetically coupled to the ring resonator is less than one-fourth of a circumference of the ring resonator.

2. A dual-mode filter comprising:

a ring resonator;

an input feeder and an output feeder disposed substantially orthogonal with respect to each other and with respect to the ring resonator so as to be electromagnetically coupled to the ring resonator; and a dual-mode generating line disposed inside the ring resonator in a manner so that the dual-mode generating line does not overlap either one of a line extending from the input feeder and a line extending from the output feeder, wherein a center of the dual-mode generating line is disposed in a manner so that an angle "θ" defined as an angle formed between a line passing through the center of the dual-mode generating line and a center of the ring resonator and a line extending from the input feeder is 45 degrees±90n degrees (n=0, 1, 2, 3), and the dual-mode generating line includes first and second ports each electromagnetically coupled to the ring resonator, and an arc-shaped waveguide connected between the first port and the second port, wherein an open angle formed between the first port and the second port with respect to a center of the ring resonator is equal to or more than 36 degrees and less than 90 degrees.

3. A dual-mode filter comprising:

a ring resonator;

an input feeder and an output feeder disposed substantially orthogonal with respect to each other and with respect to the ring resonator so as to be electromagnetically coupled to the ring resonator; and a dual-mode generating line disposed inside the ring resonator in a manner so that the dual-mode generating line does not overlap either one of a line extending from the input feeder and a line extending from the output feeder, wherein a center of the dual-mode generating line is disposed in a manner so that an angle "θ" defined as an angle formed between a line passing through the center of the dual-mode generating line and a center of the ring resonator and a line extending from the input feeder is 45 degrees±90n degrees (n=0, 1, 2, 3), the dual-mode generating line includes first and second ports each electromagnetically coupled to the ring resonator, and an arc-shaped waveguide connected between the first port and the second port, and the dual-mode filter further comprises:

a dielectric material disposed above at least one of a first coupling point between the first port and the ring resonator and a second coupling point between the second port and the ring resonator and movable in the substantially vertical direction with respect to the dual-mode generating line and the ring resonator.

4. The dual-mode filter according to claim 3, further comprising:

a driving unit for moving the dielectric material in the substantially vertical direction.

* * * * *